United States Patent [19]

Eppler

[11] Patent Number: 5,062,232

[45] Date of Patent: Nov. 5, 1991

[54] SAFETY DEVICE FOR FIREARMS

[76] Inventor: Larry D. Eppler, 1817 Highridge Cove, Carrollton, Tex. 75006

[21] Appl. No.: 483,660

[22] Filed: Feb. 23, 1990

[51] Int. Cl.[5] ..... F41A 17/06

[52] U.S. Cl. ..... 42/70.11

[58] Field of Search ..... 42/70.11, 84

[56] References Cited

U.S. PATENT DOCUMENTS

| | | | |
|---|---|---|---|
| 2,762,267 | 9/1956 | Persson et al. | 89/135 |
| 2,948,192 | 8/1960 | Evans et al. | 89/28 |
| 3,650,174 | 3/1972 | Nelsen | 42/84 |
| 3,982,347 | 9/1976 | Brandl et al. | 42/84 |
| 4,003,152 | 1/1977 | Barker et al. | 42/70.01 |
| 4,105,885 | 8/1978 | Orenstein | 42/70.11 |
| 4,298,914 | 11/1981 | Long | 89/28 R |
| 4,354,189 | 10/1982 | Lemelson | 42/70.11 |
| 4,457,091 | 7/1984 | Wallerstein | 42/70.11 |
| 4,467,545 | 8/1984 | Shaw, Jr. | 42/70.11 |
| 4,488,370 | 12/1984 | Lemelson | 42/70.11 |
| 4,563,827 | 1/1986 | Heltzel | 42/70.11 |
| 4,682,435 | 7/1987 | Heltzel | 42/70.11 |
| 4,709,615 | 12/1987 | Field | 89/28.05 |
| 4,757,629 | 7/1988 | Austin | 42/84 |

*Primary Examiner*—Charles T. Jordan

*Attorney, Agent, or Firm*—Larry B. Dwight

[57] ABSTRACT

A safety device for firearms having trigger interrupting means operably connected to the trigger mechanism of the firearm. The code generating means worn by the user or operated by the user generates a signal which is detected by detection means on the weapon to disengage the trigger interrupting means to permit the weapon to selectively be fired by an authorized user.

4 Claims, 2 Drawing Sheets

SAFETY DEVICE FOR FIREARMS

FIELD OF THE INVENTION

The present invention relates to being able to selectively disable firearms of any type to prevent unauthorized persons from discharging the weapon.

BACKGROUND OF THE INVENTION

A number of prior devices have been disclosed which attempt to disable a weapon. Some of those are disclosed in U.S. Pat. Nos. 4,682,435 and each of the references cited therein.

With the rising crime rate and increase in population there has been a rise in the demand for firearms safety. One aspect of such safety is to prevent children from taking a weapon when not authorized to do so and accidentally discharging the weapon thereby causing injury to himself or another child or children. A second area of safety is the theft of weapons and their easy accessibility to be sold on the open market. A third area is when a peace officer attempts an arrest and a struggle ensues between the peace officers and a suspect who is being arrested wherein the officer is disarmed and his weapon is used against him. Several events including law enforcement officers have occurred over the past years in which the officer was wounded or killed with his own weapon and no one has been able to successfully prevent these events. To some degree even soldiers are subject to these types of events.

With the device disclosed in U.S. Pat. No. 4,682,435, when the weapon is removed from the possession of the authorized user, further active participation is required on his part to activate a separately carried transmitter which then disables the weapon from firing. In the case of an on going struggle involving a peace officer, soldier, etc. the time delay introduced by this extra action could prove fatal.

SUMMARY OF THE INVENTION

The present invention is directed at total disabling of the weapon when the weapon is not held by the designated person. Most modern weapons, whether a revolver or automatic, have a triggering mechanism which is mechanically activated by pulling on the trigger to a point where the trigger releases a firing mechanism such as a firing pin or hammer which then strikes the rear of the cartridge to discharge the weapon. This device seeks to actively block the movement of the trigger unless a specific chain of events occur.

The first embodiment of the invention incorporates recognition means within the cavity of the weapon which will recognize a code generating means delivered by the authorized user. In the case of hand guns the preferred authorized signal would be placed on the officers hand or finger and, would only be recognized when he had his hand on the grip of the weapon. This signal would then be detected by detector means and release the firing mechanism to allow discharge of the weapon.

This embodiment would be more specifically aimed at weapons carried by peace officers or even a soldier such that if the officer was disarmed by a suspect the weapon would not function since the officer's hand would not be about the weapon delivering a code to the detector means.

A second embodiment would allow the input of a specific code which would be recognized until deactivated manually or by a time elapse control. The second embodiment is aimed at the civilian use of sporting weapons such as rifles or shot guns.

The primary object of the invention is to disable a weapon until selectively enabled by an authorized person.

A further object of the invention is to prevent the unauthorized discharge of a fire arm thereby preventing injury and death.

Other and further objects of the invention become readily apparent from studying the detailed description which hereinafter follows.

BRIEF DESCRIPTION OF THE DRAWING

The following is a brief description of the drawings which are annexed hereto to form a portion of the description.

Numeral references are used to designate like parts throughout the various figures of the drawing.

DETAILED DESCRIPTION OF THE PREFERRED EMBODIMENT

Figure 1:
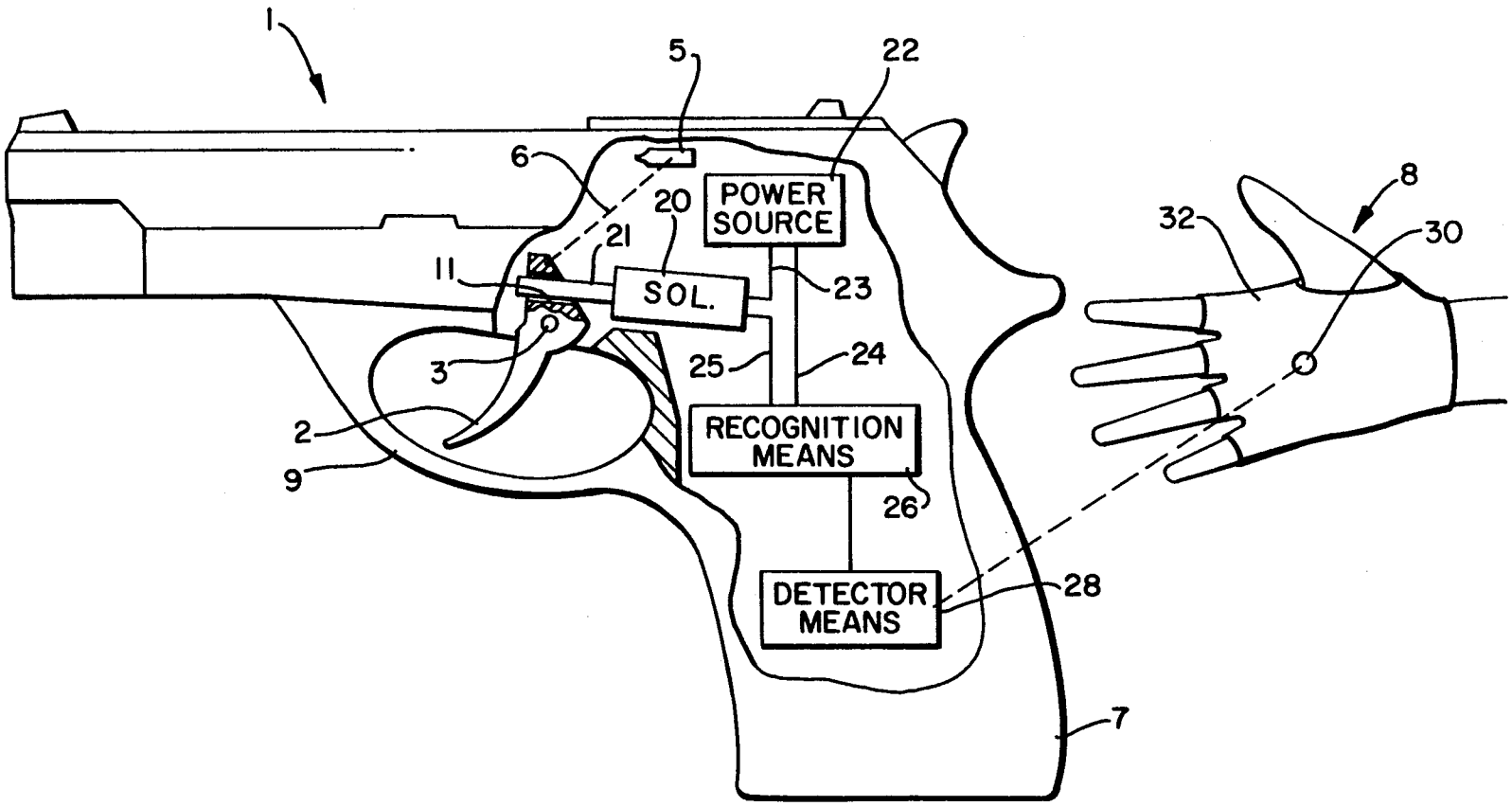
FIG. 1 is a side elevational view showing the silhouette of a typical weapon with a portion cut away to more clearly illustrate the functional device of the weapon and a schematic block diagram showing the functional portions of the invention.

FIG. 1 shows a typical hand gun 1 which for purposes of this discussion is a semi-automatic pistol but this invention is not limited to that type of weapon and may be adapted to all types of weapons including electrical type weapons such as lasers, semi automatic pistols, automatic pistols, revolvers, rifles and shotguns of all types and models. The weapon 1 has a trigger 2 which would pivot about a pin 3. Means such as linkage 6 would allow a firing pin 5 to discharge the weapon upon pulling the trigger 2. The hand grip 7 is generally hollow except for a magazine to carry the ammunition and in some weapons may provide space for housing the safety device. Typically the hand 8 of the user would grip the hand grip 7 of the weapon 1 and place a finger through a trigger guard 9 in order to pull the trigger 2.

The safety device comprises trigger disabling means 20 such as a miniature normally closed solenoid having a plunger 21 which slides into opening 11 in the trigger 2. The trigger disable means 20 would be operably connected to a power source 22 such as a battery by electrical leads 23. The other side of the power source 24 would then be connected to recognition means and a circuit would be completed through line 25 to activate the trigger disabling means 20 and withdraw the plunger 21 from aperture 11 allowing the trigger mechanism to operate normally. The recognition means 26 provides energizing circuitry to energize the trigger disable means 20. The recognition means 26 is generally an electronic circuitry which would recognize a code or signal from the code detecting means 28. Typically the code detecting means 28 would read or receive a signal from a code generating means 30 which could be attached to the finger or palm of hand by means 32 such as, but not limited to, a band or palm glove which the user would wear such as those worn by golfers or the like.

The code generating means 30 may be of several configurations such as a micro chip which has a permanent magnetic code which would then be a by the code detecting means 28 and if the codes matched would allow the recognition means 26 to then activate the trigger disable means 20 to withdraw the plunger 21. The code generating means 30 may also be a bar code which would then be optically read by the detector means 28 or any other types of digitally or specifically generated code means which would then be recognized electronically by either an optical reader or receiver in detector code means 28. The primary function of the code generating means 30 is to provide a highly distinguishable signal which can only be detected when in close physical proximity with the code detecting means so that if the authorized person was not using the weapon or did not have his hand in a proper firing position the weapon could not be fired. Matching code generation means 30 may be worn on the left and right hand so that if the peace officer or user had to switch hands with the weapon 1 he could do so and the weapon 1 would still be operable.

The recognition means 26 could be generated by several means electronically such as a series of "and" and "nand" gates to generate a signal which would be then electronically amplified to generate an electrical pulse into the trigger disable means 20 to withdraw the pin 21. A locking circuit within the recognition means 26 would hold the pin 21 open until the code generating means 30 is withdrawn from the weapon 1.

An electrically fired weapon such as future types of lasers and/or electrically fired rocket pistols, the trigger disable means 20 would be an electrical interrupter circuit which would be normally open to prevent firing of the weapon unless a specified signal from the recognition means 26 closed the circuit thus allowing the weapon to fire.

Figure 2:
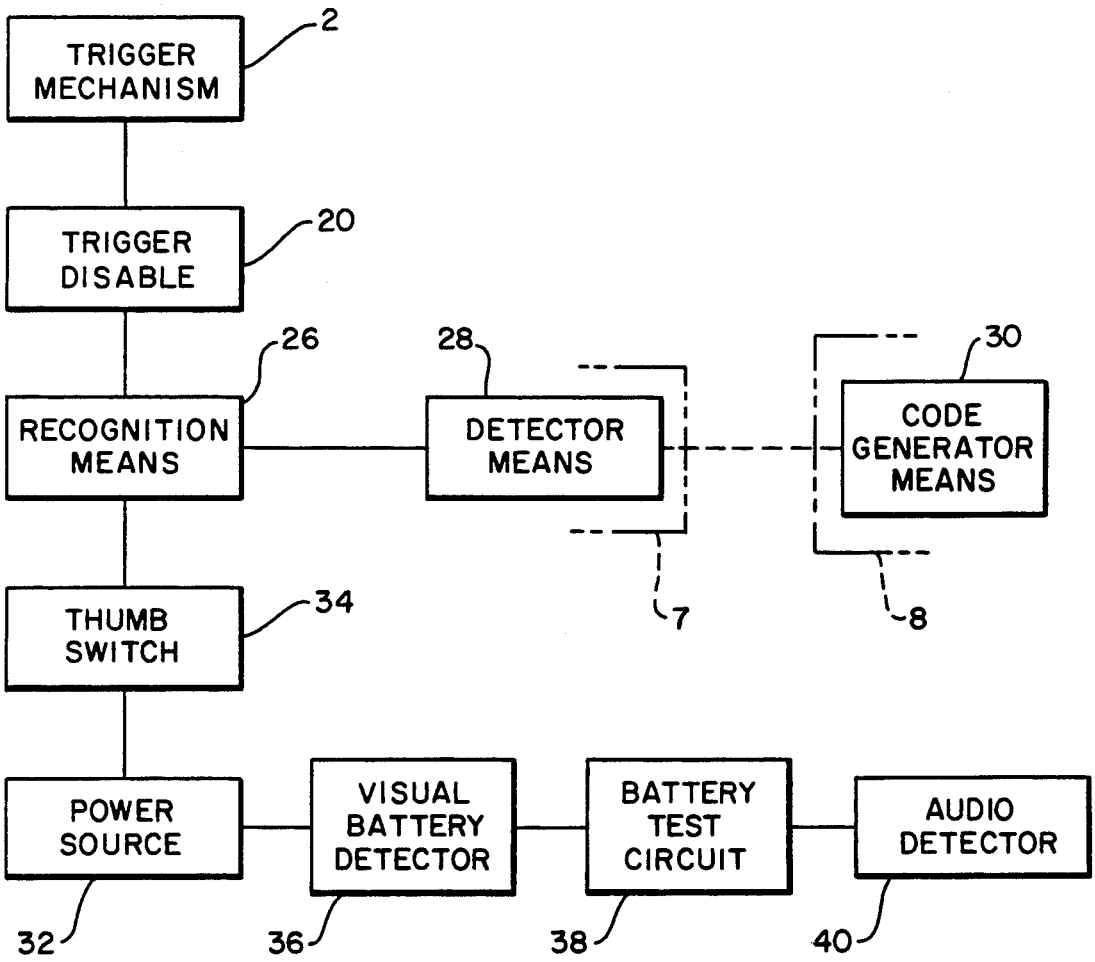
FIG. 2 is a block diagram showing the electronic portions of the device.

FIG. 2 shows a block diagram of schematically how the device would work. Typically, a power source such as a battery which is rechargeable 32 would be operably connected through a thumb switch 34 which would supply power to the recognition means 26 which would then activate the trigger interrupt means 20. The code generation means 30 would provide the specific mechanism to allow the recognition means 26 to place the trigger interrupt means 20 in the firing position. Additionally, for safety purposes a low battery indicating means 36 could provide a visual means to signal a low battery and a test circuit such as test means 38 would provide an audio signal of a low battery to the user.

An alternate embodiment of the code generation means 30 would include a series of buttons such as normally open spring loaded switches which could be pushed in a sequential order to input a code or signal which would deactivate the trigger disable means to allow the weapon to be fired. The recognition means 30 would also include timer means such that when activated would permit operation of the firearm 1 for an predetermined amount of time. This feature would be helpful for use in sporting weapons. A second timing device, started by the action of mechanical code input, could be inserted into the circuitry which would shut down the circuit if the authorized code were not inputted within a specified time frame. This would prevent children, or others, from fiddling with the circuit long enough to accidentally hit upon the authorized code. The code generation means 30 includes a means to change the input code by a predetermined code to permit other users control of the weapon without disclosing the specific input code of the owner of the weapon.

Other and further embodiments of the safety device may be devised without departing from the spirit and scope of the invention herein described and the claims annexed hereto.

Having described my intention, I claim:

1. A safety device for a firearm comprising:

a trigger mechanism operably connected to the firearm to discharge the firearm;

a power source;

trigger interrupting means operably connected to the trigger mechanism to prevent the trigger mechanism operation from movement to render the firearm inoperable;

recognition means operably connected to the trigger interrupting means and connected to the power source;

code detecting means operably connected to the recognition means to enable the recognition means to disengage the trigger interrupting means upon receipt of a signal;

code generating means to generate a signal to enable the code detecting means; and means for attaching the code generating means to the palm of a user's gun hand.

2. The combination called for in claim 1 wherein the trigger interrupting means comprises a normally closed solenoid operably connected to prevent movement of the trigger mechanism.

3. The combination called for in claim 1 with the addition of: means to determine the strength of the power source; visual means to alert the user that the power source has fallen below a predetermined strength; and audible means to alert the user that the power source has fallen below a predetermined strength.

4. A safety device for a firearm comprising:

a trigger mechanism operably connected to the firearm to discharge the firearm;

a normally closed solenoid having a pin extending outwardly and operably connected to the trigger mechanism to disable the trigger mechanism;

recognition means operably connected to the solenoid;

code detecting means operably connected to the recognition means to enable the recognition means and adapted to receive a signal;

code generating means to generate a signal to be received by the code detecting means to energize the recognition means to disengage the solenoid from the trigger mechanism to permit the firearm to be fired; and means for attaching the code generating means to the palm of a user's gun hand.

* * * * *